US006344839B1

(12) United States Patent
Denda et al.

(10) Patent No.: US 6,344,839 B1
(45) Date of Patent: Feb. 5, 2002

(54) DRIVE METHOD AND DRIVE CIRCUIT OF DISPLAY DEVICE

(75) Inventors: Hayato Denda; Masamichi Nakajima; Asao Kosakai; Junichi Onodera; Masayuki Kobayashi; Seiji Matsunaga, all of Kanagawa-ken (JP)

(73) Assignee: Fujitsu General Limited, Kawasaki (JP)

( * ) Notice: Subject to any disclaimer, the term of this patent is extended or adjusted under 35 U.S.C. 154(b) by 0 days.

(21) Appl. No.: 08/930,866

(22) PCT Filed: Apr. 2, 1996

(86) PCT No.: PCT/JP96/00899

§ 371 Date: Oct. 6, 1997

§ 102(e) Date: Oct. 6, 1997

(87) PCT Pub. No.: WO96/31865

PCT Pub. Date: Oct. 10, 1996

(30) Foreign Application Priority Data

Apr. 7, 1995 (JP) ..... 7-108191
Jul. 14, 1995 (JP) ..... 7-201387

(51) Int. Cl.[7] ..... G09G 3/36
(52) U.S. Cl. ..... 345/60; 345/88
(58) Field of Search ..... 345/60, 63, 77, 345/89, 147, 208, 148

(56) References Cited

U.S. PATENT DOCUMENTS 5,436,634 A * 7/1995 Kanazawa ..... 345/67
5,541,618 A * 7/1996 Shinoda ..... 345/60
5,583,527 A * 12/1996 Fujisaki et al. ..... 345/55
5,757,343 A * 5/1998 Nagakubo ..... 345/63
5,767,828 A * 6/1998 McKnight ..... 345/89
5,874,932 A * 2/1999 Nagaoka et al. ..... 345/60
5,953,002 A * 9/1999 Hirai et al. ..... 345/204
5,959,598 A * 9/1999 McKnight ..... 345/90

FOREIGN PATENT DOCUMENTS

| | | | |
|---|---|---|---|
| JP | 59-125182 | 7/1984 | |
| JP | 59-154884 | 9/1984 | |
| JP | 3-63692 | 3/1991 | |
| JP | 4-211294 | 8/1992 | |
| JP | 5-127613 | 5/1993 | |
| JP | 7-7702 | 1/1995 | |
| JP | 7-49663 | 2/1995 | |
| JP | 7-140922 | 6/1995 | |
| JP | 7-175439 | 7/1995 | |
| JP | 7-248743 | 9/1995 | |
| JP | 7-261696 | 10/1995 | |
| WO | PCT/JP96/00899 | * 4/1996 | ..... G09G/3/28 |

* cited by examiner

*Primary Examiner*—Bipin Shalwala
*Assistant Examiner*—Vanel Frenel
(74) *Attorney, Agent, or Firm*—Flynn, Thiel, Boutell & Tanis, P.C.

(57) ABSTRACT

In a subfield drive method, two subframes of the least brightness are arranged adjacently to each other to select and light up the display device in terms of the change in image brightness in the time axial direction. When, for example, the level of original signal changes from 7 to 8 or from 8 to 7, SF3, SF2, SF1 and SF1 are selected as subframes for level 8, and SF3, F2 and SF1 are selected as subframes for level 7. This prohibiting any continuous lighting or non-lighting at the levels 7 and 8, there is no substantial change in brightness nor degradation of picture quality at that time. Any distortion of moving image (pseudo contour) is removed by the correction circuit 20 having the frame memory 24 that delays by one frame, the correction constant set circuit 26 that outputs correction data, and the adder 28 that adds the correction data to the original image signal.

8 Claims, 7 Drawing Sheets

DRIVE METHOD AND DRIVE CIRCUIT OF DISPLAY DEVICE

TECHNICAL FIELD

This invention relates to a drive method and drive circuit intended to compensate for degraded picture quality of moving image in a display device so designed as to display multitonal image signal making up one frame with plural subframes of different relative ratios of brightness.

BACKGROUND TECHNOLOGY

The PDP (Plasma Display Panel) has recently attracted public attention as a thin, light-weight display device. Completely different from the conventional CRT driving method, the drive method of this PDP is a direct drive by digitalized image input signal. The brightness and tone emitted from the panel face depend therefore on the number of bits dealt with The PDP may be roughly divided into AC type and DC type methods whose basic characteristics are different from each other. As for the tonal display, however, 64-tone display was the maximum reported from the trial manufacture level. The Address/Display Separation type drive method (ADS subframe method) has been proposed as an approach to solve this problem.

FIGS. 1(*a*) and 1(*b*) show the drive sequence and drive waveform of the PDP used in this ADS subframe method.

In FIG. 1(*a*), which gives an example of 256 tones, one frame is composed of eight subframes whose relative ratios of brightness are 1, 2, 4, 8, 16, 32, 64 and 128, respectively. Combination of this brightness of eight screens enables a display in 256 tones.

In FIG. 2(*b*), the respective subframes SF1 to SF8 are composed of the address duration AD1, . . . that write one screen of refreshed data and the sustaining duration ST1, . . . that defines the brightness level of these subframes. In the address duration, a wall charge is formed initially at each pixel simultaneously over all the screens, and then the sustaining pulses are given to all the screens for display. The brightness of the subframes is proportional to the number of sustaining pulses to be set to the predetermined brightness. Two hundred and fifty-six tone display is thus performed.

In such an AC drive method, the greater the number of tones, the number of bits of the address duration as preparation time for the panel to emit light and brightness within one frame duration becomes. This relatively shortens the sustaining duration as emission time, lowering thus the maximal brightness.

Hence, the brightness and tone emitted from the panel face depend on the number of bits to be dealt with. With the increased number of bits of the signal processed, the picture quality improves, but the emission brightness reduces. If, on the contrary, the number of bits of the signal processed is diminished, the emission brightness augments, but the tonal display reduces, deteriorating thus the picture quality.

The error variance processing intended to minimize the grayness error between input signal and emission brightness reducing rather the bit number of output drive signal than that of input signal is a processing to represent a pseudo-intermediate (half) tone, which is used when representing the grayness with fewer tones.

In the conventional general error variance processing circuit, the image signal of n-bit (n being 8 for instance) original pixels Ai, j enters an image signal input terminal, and passes through vertical adder and horizontal adders. Further, in the bit conversion circuit, the image signal reduces its bit number to m (4, for instance, and m<n). After passing through the PDP drive circuit, it emits light from the PDP.

The error variance signal from said horizontal adder is compared with data stored beforehand by an error detect circuit, and the difference between this signal and the data is weighted by predetermined coefficient in an error load circuit. The error detect output is added to said vertical adder through the intermediary of the h line delay circuit that outputs the reproduction error Ej-1 produced at the pixel going back by h lines from the original pixel Aj, i, for example, by one line in the past, and at the same time, added to said horizontal adder through the intermediary of a d-dot delay circuit that outputs the reproduction error Ei-1 produced at the pixel going back by d lines from the original pixel Ai, j, for example, by one dot in the past. In general, the coefficients at said error load circuit are to be set so that their total sum may be 1 (one).

As a result, a stepwise emission brightness level represented by 4 bits is output momentarily at the output terminal of the bit conversion circuit. Nevertheless, the emission brightness levels above and below the step-like level are actually output alternately in predetermined proportion, which will be recognized as an averaged state. This allows for a correction brightness line with approximate y=x However, the subframe lighting method was problematical in that the picture quality worsens in a part of screen when the input level of original signal somewhat changes.

In a case where 4-bit image signal scanning from SF4 to SF1 in the sequential order of brightness as shown in FIG. 2(*a*), the level 7 is quantized by 0111 and 8 is quantized by 1000 when the input of the first and second frames of the original signal change at levels 7 and 8, respectively. At the point of change from 7 to 8, therefore, the level becomes 01111000 as shown in FIG. 2(*b*) with indiscriminate emission at the levels 7 and 8. The brightness at that time reaching about 2 times the level 7 or level 8, it looks like a white line.

Conversely at the point of change from 8 to 7, the level becoming 10000111, the non-emission duration looks like a continuous black line.

The sampling signal a before conversion as shown in FIG. 3(*c*) and the signal b converted into the waveform of ADS subfield method as shown in FIG. 3(*b*) were filtered by the LPF (Low Pass Filter) with the half of frame frequency as the cutoff frequency and compared. The comparison of these signals revealed a large difference between the point of change of the image signal level from 7 to 8 and the point of change from 8 to 7 as shown in FIG. 3(*e*),where A represents the LPF output waveform of a, and B, that of b.

In such a display and reproduction system where the image signal is time-shared into plural subframes, there exists at a point of level change a level that does not always coincide with the change of original signal when a moving image changing in the time axial direction is displayed. This was problematical since it degrades the picture quality.

It was problematical particularly because pseudo-half tone, for example, by an error variance in one tone level was accompanied by flickering in the time axial direction.

The first purpose of this invention is to provide a method to compensate for the degradation of picture quality of a moving image arising from the half-tone display of the subframe method.

DISCLOSURE OF THE INVENTION

The drive method of a display device by this invention consists in that in a display unit so designed as to display a multi-tone image signal composing one frame from plural subframes of different relative ratios of brightness, two subframes of minimal brightness are arranged adjacently to each other so that the subframe selection and lighting may be possible in response to the change of image brightness in the time axial direction.

When, for example, the level of original signal changes from 7 to 8 or from 8 to 7, the brightness of 5-bit 5-screens is used, SF3, SF2, SF1 and SF1 of 4, 2, 1, and 1 are selected as the subframes for level 8, and SF3, SF2 and SF1 of 4, 2 and 1 are selected as subframes for level 7.

More materially, when one frame changes from level 7 to 8, or from 8 to 7, the level 7 is quantized at [01110] by SF3, SF2 and SF1 out of SF4, SF3, SF2, SF1 and SF1, while the level 8 is quantized at [01111] by SF3, SF2, SF1 and SF1 out of SF4, SF3, SF2, SF1 and SF1. At the point of change from level 7 to 8, the level becomes [01110] [01111], and the lighting is discontinuous at the levels 7 and 8. At the point of change from 8 to 7, the level becomes [01111] [01110] and the non-lighting is discontinuous. The brightness at these points does not therefore change greatly, which prevents the picture quality from being deteriorated.

The drive method for display device by this invention is characterized in that a correction circuit which corrects the original image signal is provided to annihilate the difference between the original image signal and emission brightness before processing the signal by the subfield drive method. The correction circuit has an M frame delay circuit which delays by M frame or frames (M being any positive integer, M=1 for example) and outputs an original image signal, a correction constant set circuit that sets, for each pixel, a correction data intended to eliminate the difference between the original image signal and emission brightness arising from the subfield drive method, based on the original image signal and M frame delay circuit, and an adder that adds the original image signal to the correction data output by the correction constant set circuit into the image signal forming the subject of the processing by the subfield drive method.

The memory (ROM for instance) in the correction constant set circuit stores beforehand the correction data intended to measure the feature representing the relationship between the original image signal and emission brightness for the display panel on which the image is displayed by the subfield drive method and to annihilate the difference between the original image signal and emission brightness as obtained for each pixel of the display panel based on the measured data. For example, data "1" with image signals "7" and "8" as addresses is stored as correction data when the level of the image signal changes from "7" to "8", wherein "7" is the image signal (image data) going back by M frame (if M=1) or frames and "8" is the image signal of current frame.

Based on the image signal going back by M frame or frames that M frame delay circuit outputs (for instance, the signal of level "7" going back by one frame) and the image signal of current frame (for instance, signal of level "8", the correction constant set circuit reads out (with the signals of level "7" and level "8" as addresses) and outputs correction data ("1" for example) from the incorporated memory (ROM for example). The adder adds the image signal ("8" for example) of current frame to the correction data output from the correction constant set circuit ("1" for example) and adopts the added value ("9" in this example) as the input image signal to the display device. We may thus eliminate the difference between the original image signal and emission brightness arising from the subfield drive method.

BRIEF EXPLANATION OF THE DRAWINGS

FIG. 3(*b*) shows sampling points,

FIG. 3(*c*) shows a sampling signal a before change,

FIG. 3(*d*) illustrates a signal b as converted from signal a by the ADS subfield method, and FIG. 3(*e*) shows a LPF output waveform A and B of signals a and b, which illustrates a distortion by the display device.

FIG. 6(*b*) shows sampling points,

FIG. 6(*c*) shows a sampling signal a before change,

FIG. 6(*d*) illustrates the signal c, as converted by the ADS subfield method, after the correction of signal a by the correction circuit, and FIG. 6(*e*) represents the LPF output waveforms of signals a and c, which includes minimal distortion.

DETAILED DESCRIPTION OF THE INVENTION

Figure 4A:
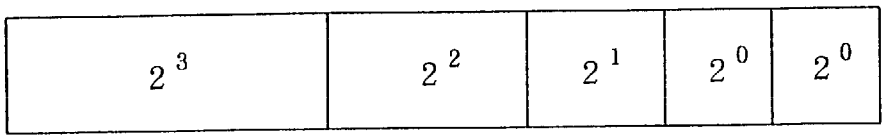
FIG. 4(*a*) shows a 5-bit drive sequence in the first embodiment of the drive method by this invention, while FIG. 4(*b*) exhibits the drive waveform at the point of change from level 7to 8, or 8 to 7 by the driving sequence in FIG. 4(*a*).
Figure 4B:
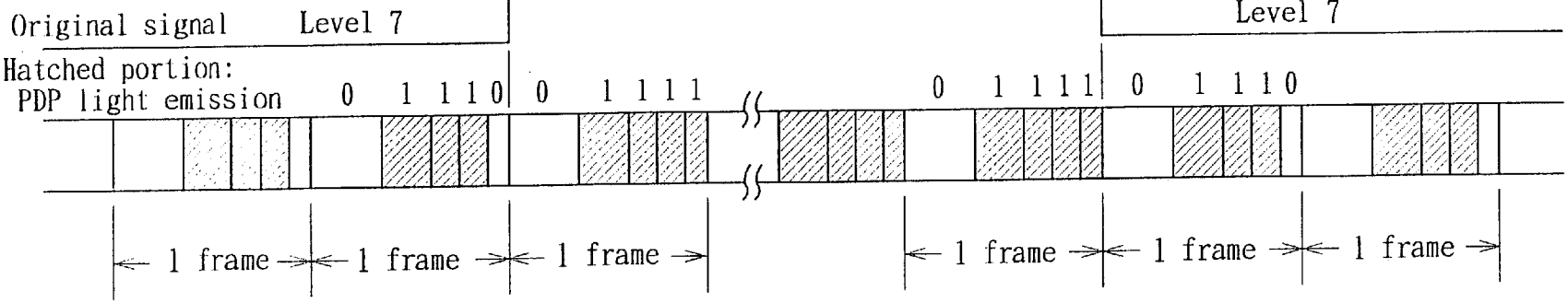

The objects of the invention will be seen by reference to the description of the first embodiment of the driving method for display device according to the invention, taken in connection with FIGS. 4(*a*) and 4(*b*).

When 1 frame consists of four subframes as in FIG. 4(*a*), conventionally these subframes were SF4, SF3, SF2 and SF1 whose relative ratios of brightness were 8, 4, 2 and 1 respectively. In this invention, one frame includes four subframes SF4, SF3, SF2, SF1 and additionally another SF1, and their relative ratios of brightness being 8, 4, 2, 1 and 1, respectively. The two SF1 with the least brightness ratio are arranged adjacently to each other.

When the level of original signal is changed from 7 to 8, or from 8 to 7 (when the variation is minimal), the brightness of 5-bit 5-screens is used.

In an embodiment wherein 16 tones are displayed using the combination of brightness of 5-bit 5-screen as shown in FIG. 4(*b*) when the level of original signal is changed from 7 to 8or from 8 to 7, the level of the first frame at the original signal being 7, the succeeding SF3, SF2 and SF1 are selected out of 5 subframes SF4, SF3, SF2, SF1 and SF1 whose relative ratios of brightness are 8, 4, 2, 1 and 1, respectively and the level 7 is quantized by [01110].

When the level of next frame is changed to 8, the succeeding SF3, SF2, SF1, and SF1 are selected out of 5subframes SF4, SF3, SF2, SF1 and SF1 whose relative ratios of brightness are 8, 4, 2, 1 and 1, respectively and the level 8is quantized by [01111]. In consequence, the level becomes [01110] [01111] as in FIG. 4(*b*) at the point of change from level 7 to 8, the lighting at the levels 7 and 8 being thus discontinuous.

Similarly, at the point of change from level 8 to 7, the level becomes [01111] [01110] as shown in FIG. 4(*b*), and the non-lighting at the levels 8 and 7 is discontinuous. The picture quality thus does not degrade because there is no great change in brightness at these points of change.

Figure 5A:
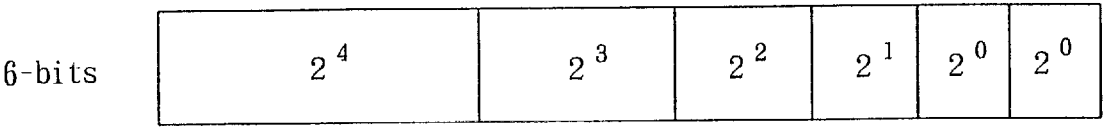
FIG. 5(*a*) schematically shows a 6-bit drive sequence in the second embodiment of the drive method by this invention, while FIG. 5(*b*) diagrammatically shows up a drive sequence at the point of change from level 15 to 16, or from 16 to 15 by the drive sequence in FIG. 5(*a*).
Figure 5B:
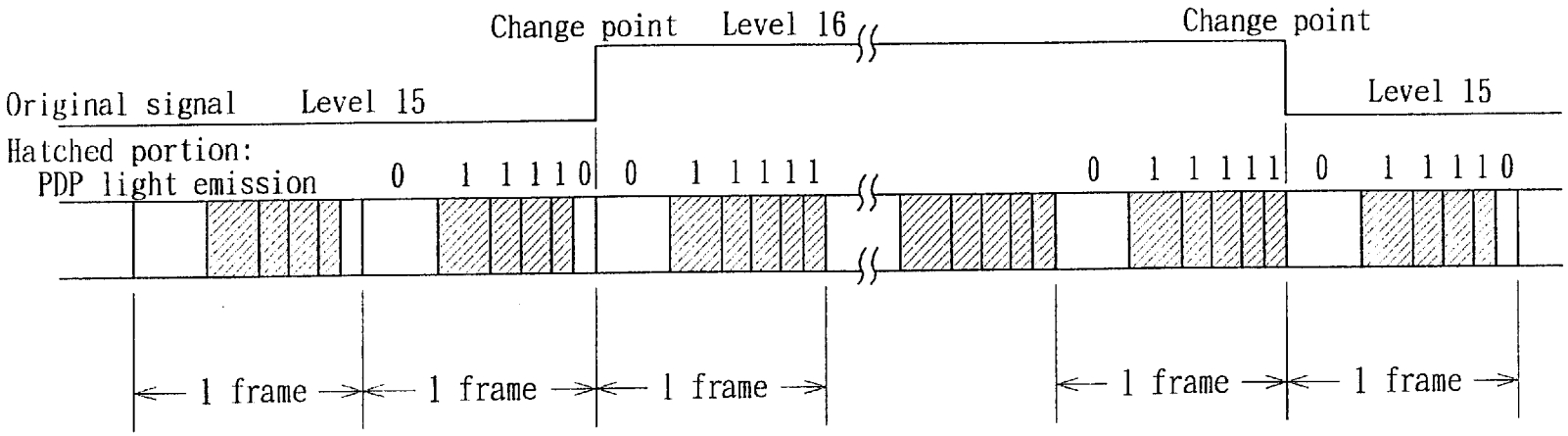

Referring now to FIGS. 5(*a*) and 5(*b*), we are going to explain the second embodiment.

In the FIG. 5(*a*) the invention, one frame includes six subframes SF5, SF4, SF3, SF2, SF1 and additionally another SF1, and their relative ratios of brightness are 16, 8, 4, 2, 1and 1, respectively. The last two subframes SF1 and SF1 having the least brightness ratio 1 are arranged adjacently to each other.

At a point where the level of original signal changes from 15 to 16, the level becoming [011110] [011111] as shown in FIG. 5(*b*), the lighting at the levels 15 and 16 is discontinuous.

Similarly at a point where the level of original signal changes from 16 to 15, the level becoming [011111] [011110] as shown in FIG. 5(*b*), the non-lighting at the levels 16 and 15is discontinuous.

Since the lighting from 16 to 15 and non-lighting from 16to 15 are both discontinuous, the brightness at these points is not subject to any great change, preventing thus the picture quality from being degraded.

In general, the foregoing embodiment may be expressed as follows.

One frame consists of n bits. The frame comprises therefore n subframes whose relative ratios of brightness are $2^{n-1}$, $2^{n-2}$, . . . $2^{n-n(=0)}$. $2^{\circ}$ of the subframe with the least relative brightness ratio 1 is added adjacently to the $2^{\circ}$ of the last subframe with least brightness ratio 1 above. Thus $2^n$ tones will be displayed making use of the combination of the brightness of (n+1) bits (n+1) screens.

When the level of original signal is changed from $[2^{n-1}-1]$ to $[2^{n-1}]$ or from $[2^{n-1}]$ to $[2^{n-1}-1]$ (when the variation is the least), the brightness of the (n+1) bits (n+1) screens is used, and SF$[2^{n-2}]$, SF$[2^{n-3}]$, . . . , SF$[2^{n-n(=0)}]$ are selected as the subframes for level $[2^{n-1}]$, while SF$[2^{n-2}]$, SF$[2^{n-3}]$, . . . , SF $[2^{n-n(=0)}]$ are selected as the subframes for level $[2^{n-1}-1]$.

As has thus far been described, this invention does not allow the picture quality to degrade despite certain change of input level of the original signal because, in a display unit so designed as to display multitonal image signal by constructing one frame from plural subframes of different relative ratios of brightness, two subframes of minimal brightness are arranged adjacently to each other, and the subframes are selected and lighted up in response to the change of image brightness in the time axial direction.

Figure 7:
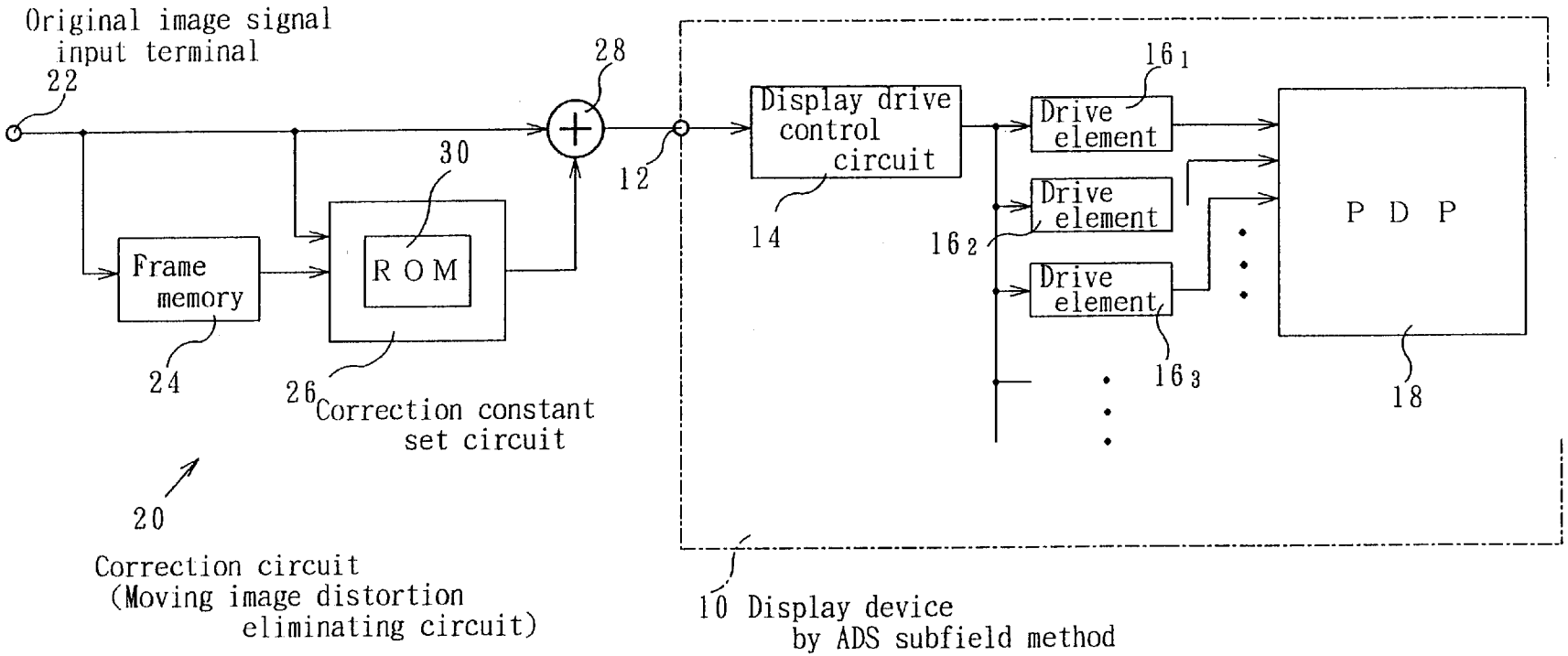
FIG. 7 is a block diagram that shows an embodiment of the drive circuit for display unit according to this invention.

We now explain an embodiment of the drive circuit for display unit by this invention Referring now to FIG. 7, the numeral 10 represents an example of display device by known ADS subfield (an example of subfield driving method), which has a display drive control circuit 14 coupled with an image signal input terminal 12, and PDP18 coupled with the output side of this display drive control circuit 14 through the intermediary of drive elements $\mathbf{16}_1$, $\mathbf{16}_2$, $\mathbf{16}_3$. . . .

The numeral 20 symbolizes a correction circuit peculiar to this invention (a circuit intended to remove the distortion of a moving image) that has the frame memory 24 as an example of M frame delay circuit (case of M=1) coupled with the original image signal input terminal 22, a correction constant set circuit 26 connected to the output side of said memory 24 and to said original image signal input terminal 22, and an adder 28 connected to the output side of said correction constant set circuit 26 and to said original image signal input terminal 22.

The correction constant set circuit 26 is provided with ROM30 as a memory, which stores beforehand correction data intended to annihilate the difference between the original image signal and emission brightness due, for every pixel, to the ADS subfield method in PDP18 whose image is displayed by the ADS subfield method. Measured are the characteristics representing the relationship between the original image signal and emission brightness for the PDP18 whose image is displayed by the ADS subfield method. Said correction data can be obtained from this measured data.

When the level of image signal is changed from "7" to "8" for example, wherein "7" is the level of the image signal (image data) going back by M frame (M=1 for instance) and "8" is the level of the image of current frame, the correction data can be obtained from the characteristic data as measured. The correction data ("1" for instance) thus obtained has been stored beforehand in ROM30 with the image signal "7" and "8" as addresses. Similarly, the correction data ("−1" for instance) when the level of image signal changes from "8" to "7" is stored beforehand in ROM30 with the image signals "8" and "7" as addresses.

The foregoing correction constant set circuit 26 has been so designed as to read out and output as set value the correction data for each pixel of PDP18 from said ROM30 (data, for example, of level "1") based on the original image signal (signal of level "8" for instance) input into said original image signal input terminal 22 and on the output signal (signal, for example, of level "7" from said memory 24. The adder 28 has been so configured that it adds the original image signal to the correction data that is output by the correction constant set circuit 26, and outputs this added value to the image signal input terminal 12 of said display unit 10.

Figure 6:
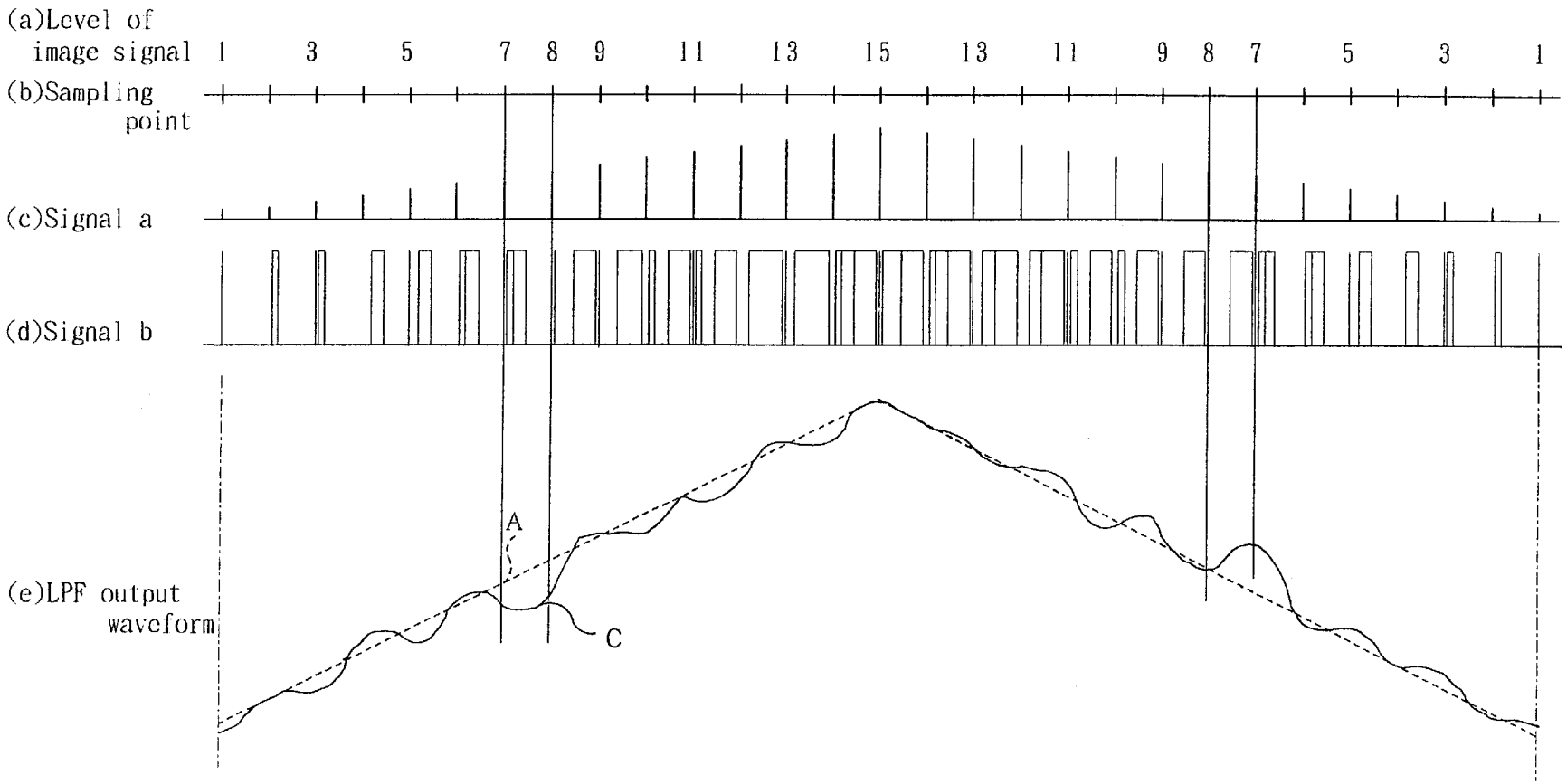
FIG. 6(*a*) shows the of original 4-bit image signal.

Concomitantly referring to FIG. 6, we will now explain the action of the foregoing embodiment. Our description will be based on a suggestion that the correction data stored in ROM30 is "0" (that is, no correction required) respectively when the level of the original image signal as sampled for corresponding pixel and for each frame is changed as . . ., "6", "7", "8" . . . , "8", "7", "6" . . . and when this level changes from "6" to "7" and from "7" to "6", that the correction data as stored in ROM30 is "1" when the level changed from "7" to "8" and that the correction data as stored in ROM30 is "−1" when the level changed from "8" to "7".

(a) When the level of the image signal as input into the input terminal 22 one frame before is "7" and that of the current frame is "8" the correction constant set circuit 26 reads out the correction data "1" from the ROM30 with the signals of levels "7" and "8" as addresses, and outputs this data as set value to the adder 28.

(b) The adder 28 adds the correction data "1" as output from the correction constant set circuit 26 to image signal (level "8") of current frame as input into the input terminal 22, and outputs this data to the input terminal 12 of display unit 10 as a corrected image signal (level "9").

(c) When the level of the image signal as input into the input terminal 22 one frame before is "8" and that of current frame is "7" the correction constant set circuit 26 reads out correction data "−1" from ROM30 with the signals of levels "8"and "7" as addresses and outputs this data as set value to the adder 28.

(d) The adder 28 adds to the image signal (level "7") of current frame input into the input terminal 22 the correction data "−1" to be output from the correction constant set circuit 26, and outputs this data as corrected image signal (level "6") to the input terminal 12 of display unit 10.

When consequently the original image signal whose level changes as . . . , "6", "7", "8", . . . , "8", "7", "6", . . . for each frame and for corresponding pixel is input into the input terminal 22, corrected will be the difference between the emission brightness and original image signal of PDP18 arising from the ADS subfield method when the level changes from "7" to "8" and from "8" to "7" From the correction circuit 20, therefore, corrected image signal whose level changes as . . . , "6", "7", "8", . . . , "8", "7", "6", . . . for each frame and for corresponding pixel is input into the input terminal 12 of the display unit 10.

As was the case with conventional embodiments, the display unit 10 lights up and displays the PDP 18 with the signal processing (signal conversion) by the ADS subfield method through the drive control of drive elements $\mathbf{16}_1$, $\mathbf{16}_2$, $\mathbf{16}_3$, . . . by the display drive control circuit 14, when the difference between the original image signal and emission brightness due to the ADS subfield method is corrected by the correction circuit 20, and this correction signal is input as an image signal into the input terminal 12. Hence a moving image can be displayed on the PDP18 without any distortion (pseudo contour).

Figure 1A:
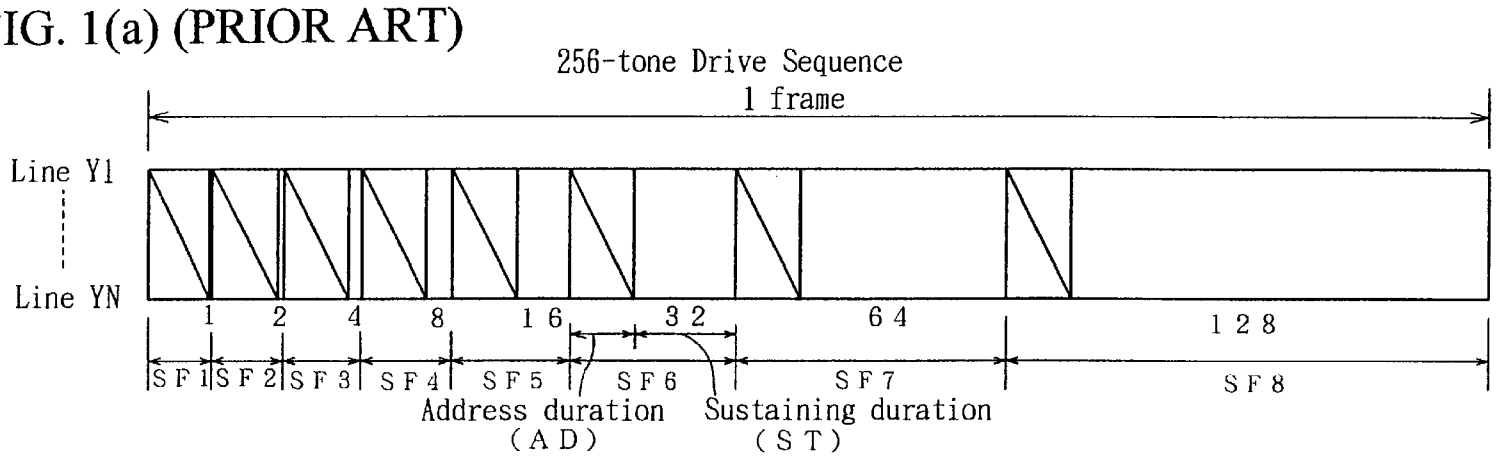
FIG. 1(a) (PRIOR ART)
FIG. 1(*a*) represents a drive sequence of 8-bit 256tones according to the ADS subfield method, and FIG. 1(*b*) illustrates a drive waveform corresponding to the sequence in FIG. 1(*a*).
Figure 1B:
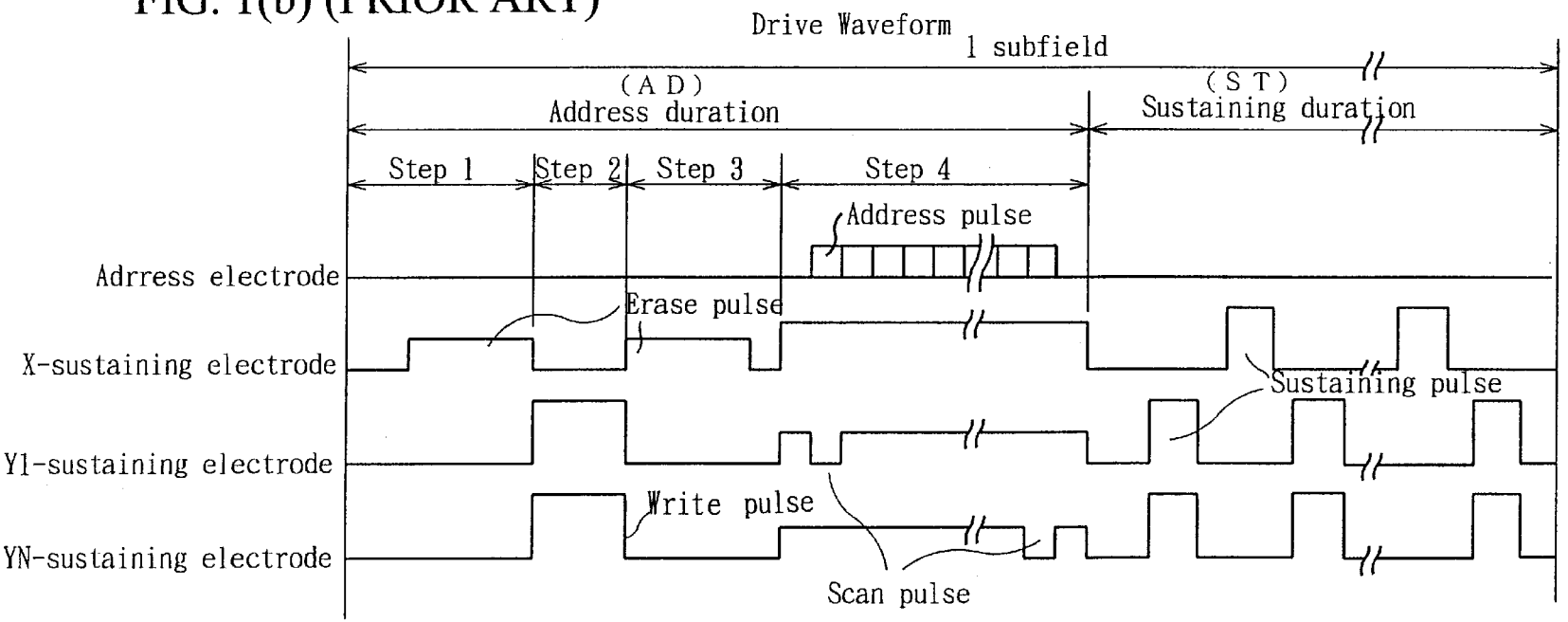
FIG. 1(b) (PRIOR ART)
Figure 2A:
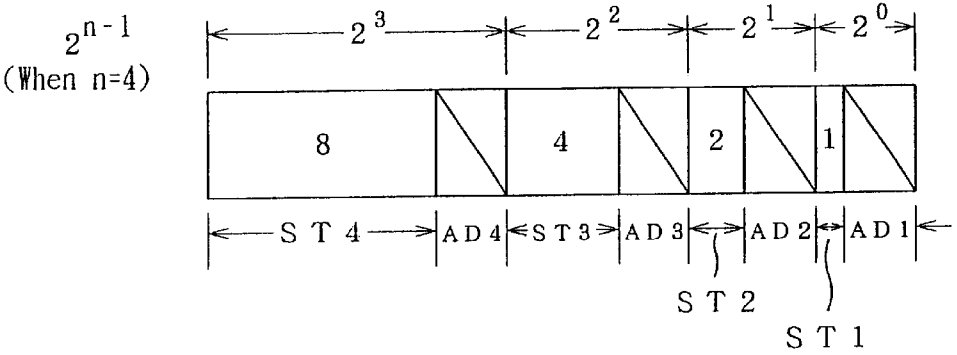
FIG. 2(a) (PRIOR ART)
FIG. 2(*a*) depicts a conventional 4-bit 16 tone drive sequence by ADS subfield method, and FIG. 2(*b*) depicts the drive waveform at the point of change from 7 to 8, or 8 to 7 by the drive sequence in FIG. 2(*a*).
Figure 2B:
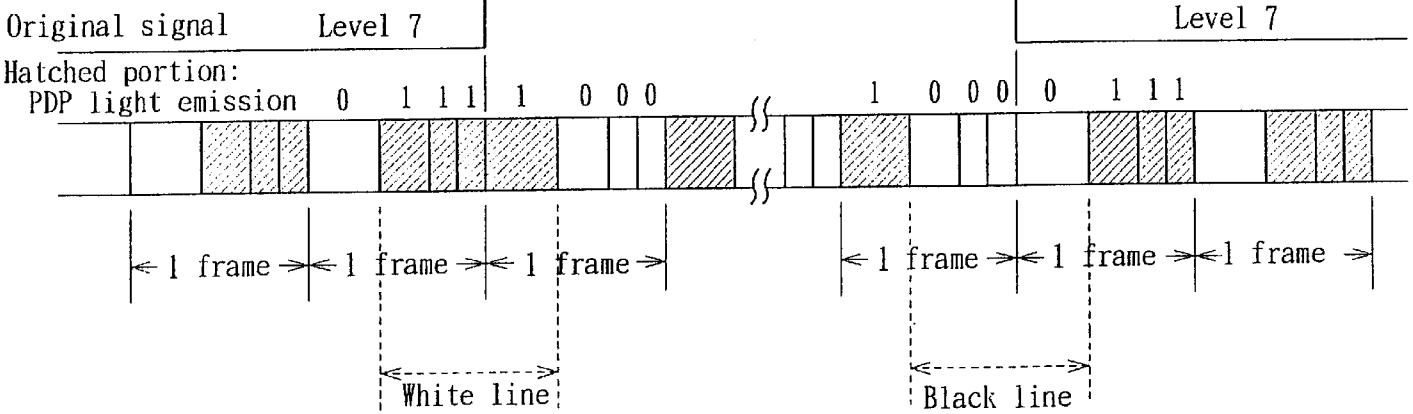
FIG. 2(b) (PRIOR ART)
Figure 3:
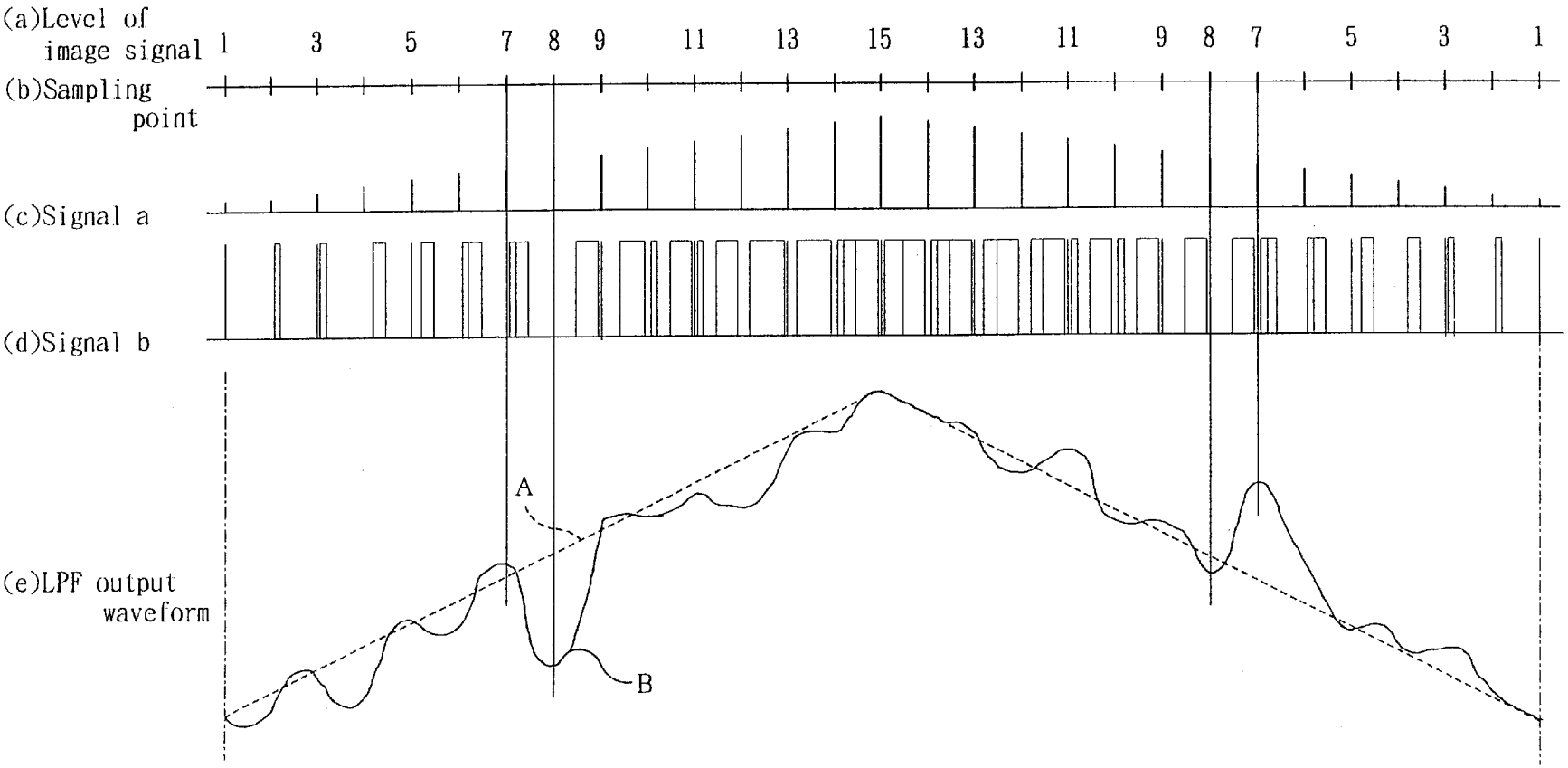
FIG. 3 (PRIOR ART)
FIG. 3(*a*) represents the level of an original image signal (4-bit)

We studied the image signal wherein the difference between the original image signal and emission brightness due to the ADS subfield method is corrected as above in a similar fashion as in FIG. 5. We passed the original image signal (sampling signal) a before its being converted into the waveform of ADS subfield method and the signal c which is the signal a as corrected by the correction circuit 20 according to this invention, then converted into the waveform by the ADS subfield method, into the LPF (Low Pass Filter) with the half of the frame frequency as the cutoff frequency to compare these two signals. As shown in FIG. 2(*e*), we could by far decrease the distortion in the time axial direction at the change point of image signal level from "7" to "8" and that from "8" to "7" than the conventional one as shown in FIG. 3(*e*).

In the foregoing embodiment, an explanation was made on the case where this the M frame delay circuit is composed of a frame memory that delays the circuit by one frame, but this invention is not limited to this type of embodiment. Any M frame delay circuit (M being a positive integer) will do if it delays the original image signal by M frame or frames to output the delayed signal.

In the foregoing embodiment, a correction data was set by correction constant set circuit to annihilate the difference between the original image signal and emission brightness of display panel resulting from the ADS subfield method, and the adder added original image signal to the correction data as output by the correction constant set circuit for the display unit to have the corrected image signal, but the invention is not limited to this type of embodiment. The corrected image signal to the display unit may be had by a correction constant set circuit (correction image signal output circuit) provided with the adding ability.

That is, a correction data may be set to eliminate the difference between the original image signal and emission brightness due to the ADS subfield method for every pixel, based on the original image signal for each pixel of display panel and on the output signal from the M frame delay circuit, and the corrected image signal to the display unit may be had providing a certain image signal output circuit that adds said set correction data to the original image signal and then outputs this data.

In the foregoing embodiment, an explanation was given about the use of this invention on a display device by means of the ADS subfield method, but the invention is not limited to this type of embodiment. The present invention may be used for a display wherein one screen display duration of display panel may be time-shared into the display duration of bit number N (N being an integer not less than 2) corresponding to the displayed tone, and the number of sustaining pulses for each divided display duration may form the subject of a weighting corresponding to each bit to display multitonal image (that is, a display device by subfield drive method).

In the foregoing embodiment, an explanation has been given on a case where the display panel of the display device is a PDP, but this invention is not limited to this type of embodiment. The invention may be used also for such a display unit where the display panel is LCDP—(Liquid Crystal Display Panel).

As has thus far been described, this invention gives a correction circuit provided with a M frame delay circuit, a correction constant set circuit and adder in order to correct the original image signal before the signal processing by the subfield drive method in a display unit so designed as to display the multitonal image by the subfield drive method Further, the memory (ROM for instance) in this correction constant set circuit stores beforehand a correction data intended to eliminate the difference between the original image signal and emission brightness. This correction data intended to cancel out the difference between the original image signal and emission brightness may be obtained from the measured values of original image signal and emission brightness on the display panel whose image is displayed by, for example, the subfield drive method. For instance, the correction data has been stored as "1" when the image signal level changes from "7" to "8" in such a fashion that the image signal level going back by M frame or frames is "7" and the image signal level of current frame is "8".

The correction constant set circuit reads out and outputs correction data ("1" for instance) from the memory (ROM for instance), based on the image signal going back by M frame or frames that M frame delay circuit outputs (signal of level "7" going back by one frame) and the image signal of current frame (signal of level "8" for instance). The adder outputs, as correction image data, to the display unit this correction data plus the image signal of current frame ("9" for example). This allows us to annihilate the difference between the original image signal and emission brightness resulting from the subfield drive method and remove the distortion of moving image (pseudo contour).

This invention is effective particularly for the display units that perform a pseudo-half tone display between one-tone levels by error variance.

What is claimed is:

1. A drive method for a display unit for displaying a multitonal image signal comprising one frame with plural undivided subframes of different relative ratios of brightness, wherein one frame consists of n bit or bits, and $2^0$ of an additional subframe with relative ratio of least brightness 1 is added adjacently to $2^0$ of an original subframe with relative ratio of the least brightness 1 out of the n subframes whose relative ratios of brightness are $2^{n-1}$, $2^{n-2}$, . . . , $2^{n-n(=0)}$ to select and light up the display unit in response to a change in image brightness in a time axial direction.

2. A drive method for a display unit for displaying a multitonal image signal comprising one frame with plural undivided subframes of different relative ratios of brightness, wherein $2^0$ of an additional subframe with relative ratio of least brightness 1 is added adjacently to $2^0$ of an original subframe with relative ratio of the least brightness 1 out of the n subframes SF whose relative ratios of brightness are $2^{n-1}$, $2^{n-2}$, . . . , $2^{n-n(=0)}$, brightness of (n+1) bits and (n+1) screens is used when the level of the original signal is changed from $(2^{n-1}-1)$ to $(2^{n-1})$ or from $(2^{n-1})$ to $(2^{n-1}-1)$ and $SF(2^{n-2})$, $SF(2^{n-3})$, . . . $SF(2^{n-(=0)})$, are selected as subframes for level $(2^{n-1})$, and $SF(2^{n-2})$, $SF(2^{n-3})$, . . . , $SF(2^{n-n(=0)})$ are selected as subframes for level $(2^{n-1}-1)$.

3. A correction circuit for a display device using a subfield drive method wherein one screen display duration of a display panel is time-shared into n-bit display durations, N being an integer not less than 2, corresponding to a tonal display and the number of sustaining pulses of each divided display duration is subjected to weighting corresponding to each bit to display a multitonal image, wherein said correction circuit corrects an original image signal before signal processing by said subfield drive method, said correction circuit being provided with a M frame delay circuit that outputs said original image signal retarding it by M frame or frames, M being a positive integer, with a correction constant set circuit that sets and outputs a correction data to eliminate the difference between average emission brightness due to the deviation of image display duration and the original image signal arising from said subfield drive method for each pixel of said display panel, based on said original image signal and the output signal of said M frame delay circuit, and with an adder that adds said original image signal to the correction data as output by the correction constant set circuit, into an image signal for processing by said subfield drive method.

4. A moving image distortion elimination circuit for a display device using a subfield drive method wherein one screen display duration of a display panel is time-shared into n-bit display durations, n being an integer not less than 2, corresponding to a tonal display and the number of sustaining pulses of each divided display duration is subjected to weighting corresponding to each bit to display a multitonal image, wherein said moving image distortion elimination circuit corrects an original image signal before signal processing by said subfield drive method, said elimination circuit being provided with a M frame delay circuit that outputs said original image signal retarding it by M frame or frames, M being a positive integer, with a correction constant set circuit that sets a correction data to eliminate the difference between average emission brightness due to a deviation of image display duration and the original image signal arising from said subfield drive method for each pixel of said display panel, based on said original image signal and the output signal of said M frame delay circuit, and adds the correction data as set to said original image signal to form an image signal for processing by said subfield drive method.

5. A moving image distortion elimination circuit for a display device as in claim 4, wherein the M frame delay circuit consists of one frame memory that outputs the original image signal delayed by one frame.

6. A correction circuit for a display device as in claim 3, wherein the M frame delay circuit comprises a frame memory that outputs the original image signal delayed by one frame.

7. A drive method for a display unit for displaying a picture according to a multitonal image signal with one frame comprising a plurality of subframes differing in relative ratios of brightness, wherein another subframe of least brightness level out of the subframes is added adjacent to the one subframe of least brightness level so that light-up can be selectively controlled according to change in luminance level in a time axial direction.

8. The drive method for a display unit of claim 7, wherein the one subframe of least brightness level and the another subframe of least brightness level both have identical relative ratios of brightness.

* * * * *